US006612270B2

(12) United States Patent
Fegg et al.

(10) Patent No.: US 6,612,270 B2
(45) Date of Patent: Sep. 2, 2003

(54) FLUID-MOVING APPARATUS AND METHOD FOR COOLING AN INTERNAL-COMBUSTION ENGINE

(75) Inventors: Stefan Fegg, Korntal-Münchingen (DE); Klaus Fuoss, Balingen (DE)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 10/025,224

(22) Filed: Dec. 19, 2001

(65) Prior Publication Data

US 2002/0092484 A1 Jul. 18, 2002

(30) Foreign Application Priority Data

Jan. 5, 2001 (DE) ..... 101 00 373

(51) Int. Cl.[7] ..... F01P 5/10
(52) U.S. Cl. ..... 123/41.44; 415/205
(58) Field of Search ..... 123/41.44, 41.09; 415/205, 206

(56) References Cited

U.S. PATENT DOCUMENTS

| | | | | |
|---|---|---|---|---|
| 4,436,067 A | | 3/1984 | Fritzenwenger | |
| 5,358,380 A | * | 10/1994 | Arakawa | 415/200 |
| 6,062,812 A | | 5/2000 | Ozawa | |
| 6,112,706 A | | 9/2000 | Heer | |
| 6,253,782 B1 | | 7/2001 | Raghu | |

FOREIGN PATENT DOCUMENTS

| | | |
|---|---|---|
| DE | 1046952 | 6/1959 |
| DE | 2157588 | 5/1974 |
| EP | 0915237 | 5/1999 |
| FR | 2681906 | 4/1993 |

* cited by examiner

*Primary Examiner*—Tony M. Argenbright
*Assistant Examiner*—Katrina B. Harris
(74) *Attorney, Agent, or Firm*—Michael Best & Friedrich LLP

(57) ABSTRACT

An coolant pump for an internal-combustion engine including a housing, a cover sealingly coupled to the housing, an impeller assembly located between the housing and the cover, the impeller assembly defining a longitudinal axis and being rotatable about the longitudinal axis; and a flange positioned between the housing and the cover adjacent the impeller assembly such that the flange and the cover define a first cavity, the flange and the housing define a second cavity, and the flange includes an opening fluidly connecting the first and second cavities, the flange being contoured to at least partially surround the impeller assembly. Preferably, the pump also includes a nozzle contoured to direct a coolant from the first cavity toward the second cavity and onto the impeller assembly, and wherein the nozzle has an intake side communicating with the first cavity and a discharge side communicating with the second cavity.

19 Claims, 3 Drawing Sheets

2
62
62
68
60
8
60
60
82
30
28
32
60
60
16
11
10
44
12
40
38
36
80
60
60
6
60
60
E
60
4
88
78
60
60
60

68
4
76
63
2
6
80
70
8
72
78
79
74
88
90
86
10
18
32
66
28
84
16
L
38
44
64
40
42
34
36
11
30
12
18
E
62
60

FLUID-MOVING APPARATUS AND METHOD FOR COOLING AN INTERNAL-COMBUSTION ENGINE

FIELD OF THE INVENTION

The invention relates generally to coolant circulation systems for internal-combustion engines, and more specifically to coolant circulation systems for use in motorcycle engines.

BACKGROUND OF THE INVENTION

One example of a fluid-moving device or pump for use with an internal-combustion engine is disclosed in U.S. Pat. No. 4,436,067. Pumps of this type generally include a housing, a cover, and an impeller assembly arranged between the housing and the cover. The impeller assembly generally conveys a coolant from a low-pressure side of the pump to a high-pressure side of the pump. The coolant then travels from the high-pressure side throughout the engine to cool various elements within the engine before returning to the low-pressure side and being recycled through the pump.

In many conventional pumps, there is a tendency for at least a portion of the coolant to leak from the high-pressure side to the low-pressure side, thereby reducing the efficiency of the pump. It is therefore desirable to reduce or eliminate leakage of coolant from the high-pressure side to the low-pressure side of the pump. Also, the pump should be relatively simple to manufacture and assemble and should include relatively few parts.

SUMMARY OF THE INVENTION

The present invention provides an apparatus for cooling internal-combustion engines by cycling a coolant through the engine to cool engine components during operation and startup of the engine. In the present invention a pump is preferably mounted relatively close to the crankcase and is selectively in fluid communication with a coolant loop, which preferably extends throughout the engine and a radiator.

In particular, the pump includes a housing and a cover sealingly coupled together with a flange arranged between the housing and the cover. The cover and the flange define a first or low-pressure cavity. The housing and the flange define a second or high-pressure cavity. A central opening, extending through the flange, connects the first and the second cavities. An impeller assembly, which includes an impeller shaft, extends through an aperture in the housing into the high-pressure cavity for rotation about a longitudinal axis. Fasteners such as bolts, screws, adhesives, clasps, and the like preferably hold the cover, the flange, and the housing together. Also, fasteners preferably hold the pump on the engine.

The impeller assembly is preferably mounted relatively close to the flange to draw coolant from the first cavity through the central opening in the flange and into the second cavity. To improve the efficiency of the pump and to prevent coolant from leaking past the impeller assembly from the second cavity to the first cavity, the impeller assembly is positioned immediately adjacent the central opening, with only enough clearance between the flange and the impeller assembly to allow the impeller assembly to rotate about the longitudinal axis without contacting the flange. In this manner, the impeller assembly can draw coolant from the first cavity to the second cavity and can simultaneously prevent or limit coolant from leaking through the central opening and from the second cavity to the first cavity. Additionally, a seal is preferably maintained between the cover and the flange so that coolant cannot leak out of the second cavity to the outside of the pump.

In a second aspect of the present invention, the impeller assembly has a relatively circular hub. An aperture preferably extends through the hub for receiving the impeller shaft. A front face of the impeller assembly is adjacent the central opening. Preferably, arcuately shaped blades are coupled to the front face of the impeller assembly and extend radially from the hub, curving toward the periphery of the front face. The blades are preferably contoured to draw the coolant from the first cavity through the flange and into the second cavity. Preferably, rotation of the arcuately shaped blades within the second cavity creates an area of suction, which draws coolant from the first cavity into the second cavity. Also, the arcuately shaped blades preferably prevent or limit coolant from leaking past the impeller assembly from the second cavity to the first cavity.

Preferably, a nozzle is coupled to the flange. The nozzle preferably has a first end in fluid communication with the first cavity and a second end in fluid communication with the second cavity. The second end of the nozzle preferably has a diameter slightly larger than the diameter of the front face of the impeller assembly so that the front face of the impeller assembly can extend into the second end of the nozzle. The nozzle is preferably a converging-diverging nozzle, with relatively wide openings at the first and second ends, tapering to a throat positioned between the first and second ends.

In operation, coolant preferably enters the pump through one or more coolant intake ducts, which are preferably in fluid communication with the coolant loop and/or the radiator. Preferably, rotation of the impeller assembly within the second cavity causes the pressure in the second cavity to be relatively higher than the pressure in the first cavity. Additionally, the pressure in the coolant loop, extending throughout the engine, is preferably relatively higher than the pressure in the first cavity. This difference in pressure causes coolant to be drawn from the coolant loop and/or the radiator into the first cavity through the coolant intake ducts. Next, the impeller assembly draws the coolant from the relatively low-pressure first cavity, through the opening in the flange.

Preferably, the impeller assembly draws coolant into the nozzle through the first end of the nozzle. The coolant travels through the throat, is directed through the second end of the nozzle onto the arcuately shaped impeller blades, and is flung off of the blades into the second cavity. In this manner, the nozzle and the impeller assembly preferably minimize turbulence and maintain relatively laminar flow through the nozzle. Additionally, the relatively close contact between the second end of the nozzle and the front face of the impeller assembly limits the coolant from leaking through the central opening from the second cavity to the first cavity, thereby improving the efficiency of the pump. Also, as coolant passes through the throat of the nozzle, the pressure and/or the flow rate of the coolant is increased, thereby further preventing or limiting coolant from leaking back through the nozzle from the second cavity to the first cavity.

In another aspect of the present invention, the arcuately shaped blades draw the coolant from the first cavity along a path, which is substantially parallel to the longitudinal axis. The arcuately shaped blades then force the coolant into the second cavity along a path extending radially away from the longitudinal axis.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 3:
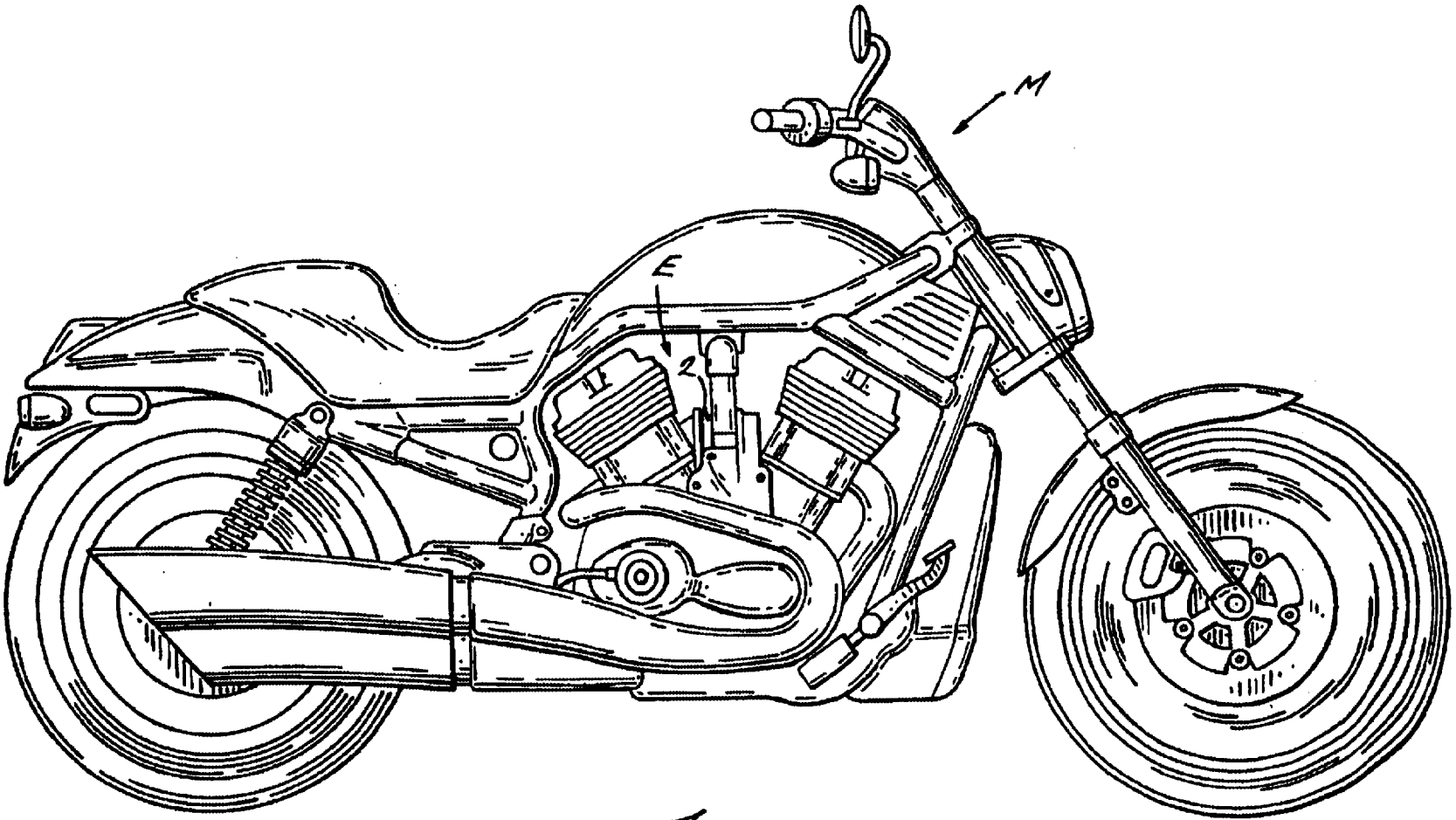
FIG. 3 is a perspective view of a motorcycle having an internal-combustion engine embodying the invention.

A fluid-moving device or pump 2 is described herein for moving a coolant in an engine E. In different applications, the coolant can be water, antifreeze, or any other similar fluid in either a gaseous or a liquid state. Referring to FIG. 3, the internal-combustion engine E is preferably the prime mover for a motorcycle M.

Figure 1:
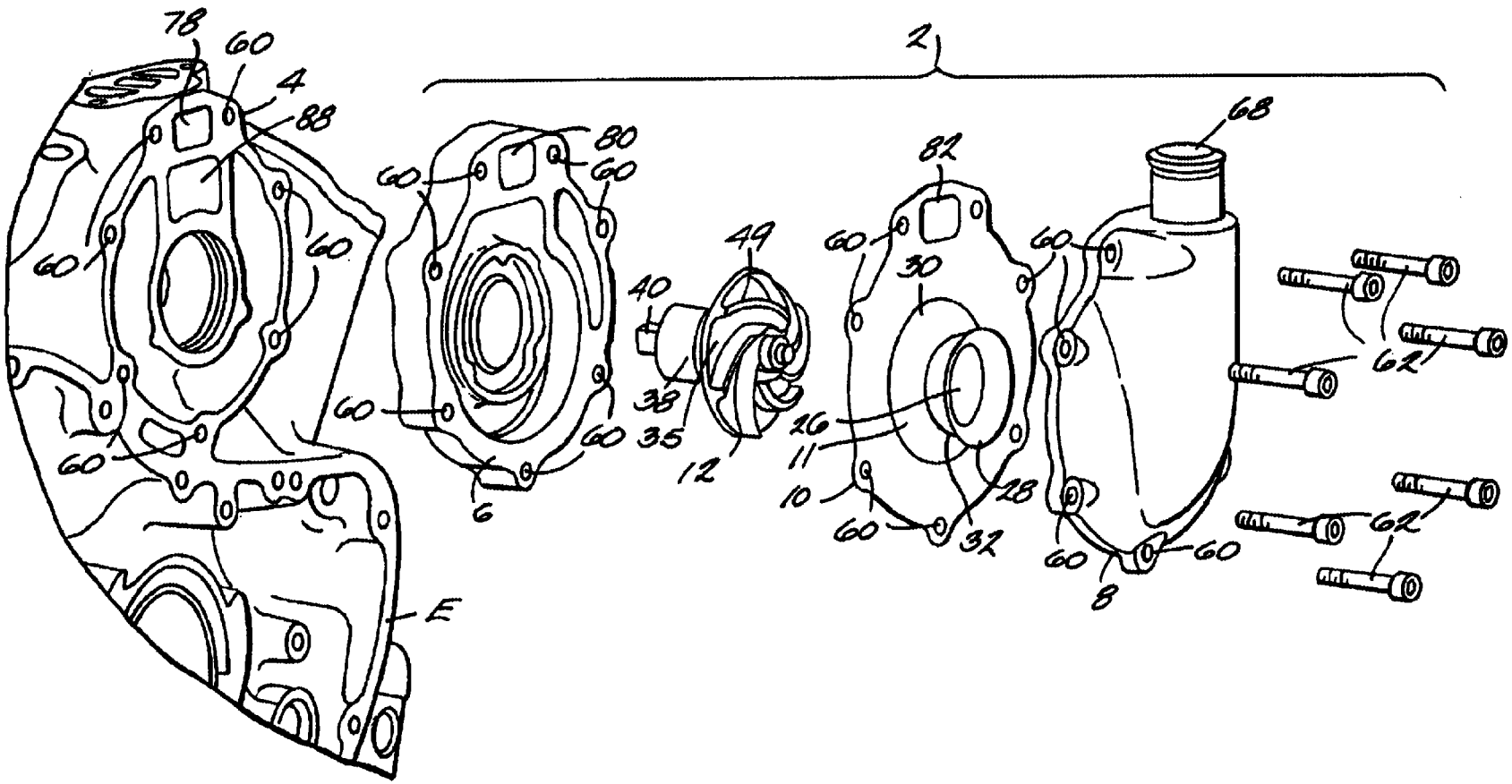
FIG. 1 is an exploded perspective view of a pump embodying the invention.
Figure 2:
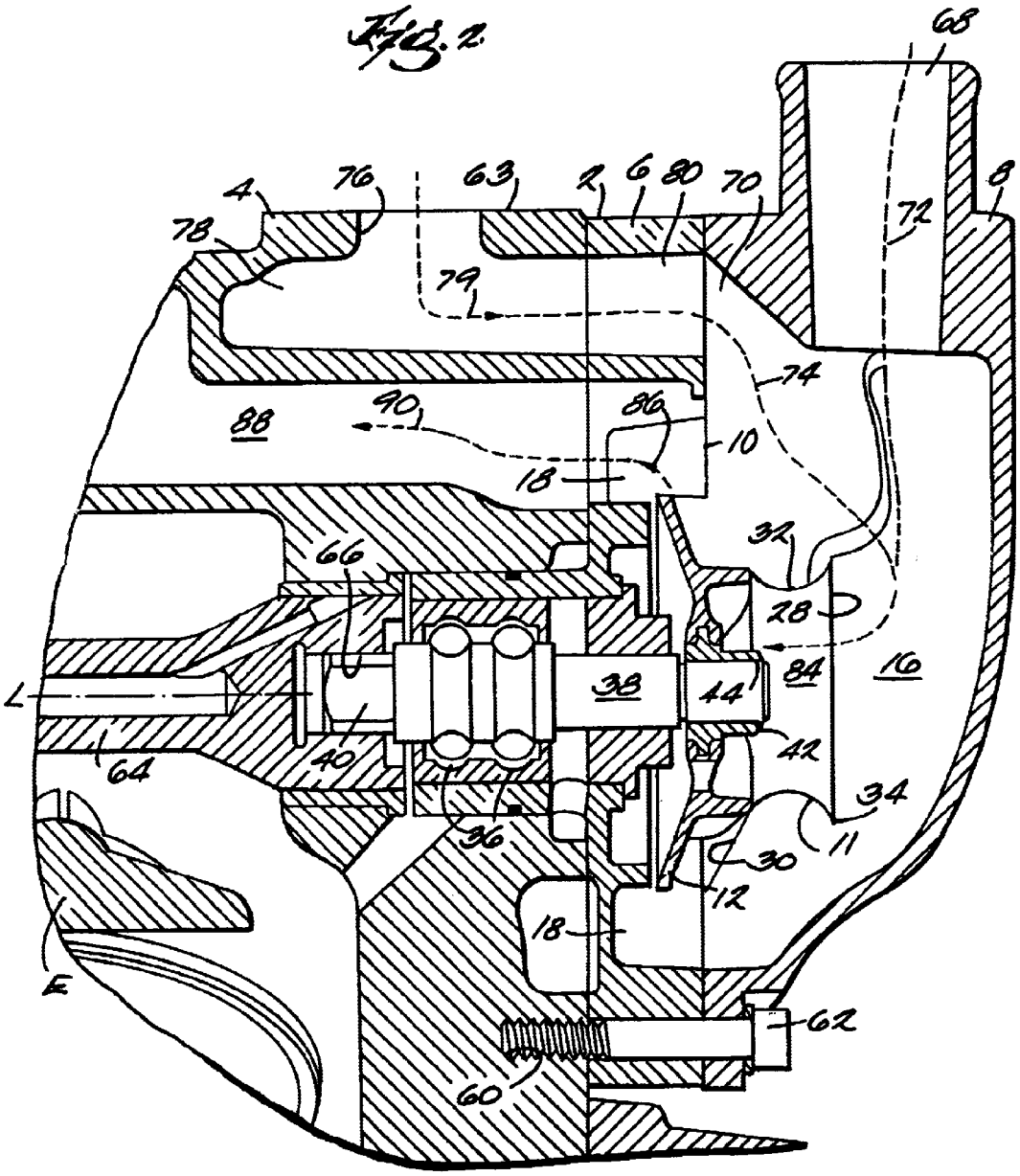
FIG. 2 is a section view of the assembled pump of FIG. 1.

Referring now to FIGS. 1 and 2, the pump 2 is mounted on a crankcase 4 of an internal-combustion engine E. The pump 2 includes a housing 6, a cover 8, a flange 10 arranged between the housing 6 and the cover 8, a nozzle 11 coupled to the flange 10, and an impeller assembly 12 extending through an aperture 14 in the housing 6 along a longitudinal axis L (shown in FIG. 2).

As seen in FIG. 2, the pump 2 has a first or low-pressure cavity 16 (often referred to as the suction side), defined by the cover 8 and the flange 10, and a second or high-pressure cavity 18 (often referred to as the discharge side), defined by the flange 10 and the housing 6. Coolant within the low-pressure cavity 16 is at a relatively low pressure while coolant within the high-pressure cavity 18 is at a relatively high pressure.

As shown in FIGS. 1 and 2, the flange 10 is arranged between the housing 6 and the cover 8. A central opening 26 (see FIG. 1) extends through the flange 10, fluidly connecting the low-pressure cavity 16 and the high-pressure cavity 18.

The flange 10 and the nozzle 11 may be made from a single piece of sheet metal, which is deep drawn to form the nozzle 11. Alternatively, the nozzle 11 may be fixedly coupled to the flange 10. Referring to FIG. 2, the nozzle 11 is coupled to the flange 10 to channel coolant through the central opening 26 between the low-pressure cavity 16 and the high-pressure cavity 18.

The nozzle 11 (see FIGS. 1 and 2) has an intake side 28 that opens into the low-pressure cavity 16, a discharge side 30 that opens into the high-pressure cavity 18, and a throat 32 between the intake and discharge sides 28, 30. The diameter of the nozzle 11 is relatively large at the intake and discharge sides 28, 30 and the diameter of the nozzle 11 is relatively small at the throat 32, with the diameter at the discharge side 30 preferably being larger than the diameter at the intake side 28. Thus, the nozzle 11 is a converging-diverging nozzle. As best seen in FIG. 2, the intake side 28 of the nozzle 11 has a lip 34 that curls out and away from the longitudinal axis L. The discharge side 30 is contoured to closely engage and to partially surround the impeller assembly 12 (see FIG. 2). In this manner, the discharge side 30 directs coolant from the low-pressure cavity 16 onto the impeller assembly 12 and prevents or limits coolant from leaking back through the nozzle 11 from the high-pressure cavity 18 to the low-pressure cavity 16. Also, the converging-diverging shape of the nozzle 11 reduces the inflow resistance experienced at the impeller assembly 12.

As shown in FIGS. 1 and 2, the impeller assembly 12 extends through at least a portion of the crankcase 4 and into the high-pressure cavity 18 through the aperture 14 in the housing 6. The impeller assembly 12 is positioned immediately adjacent the central opening 26, with only enough clearance between the flange 10 and a front face 35 (see FIG. 1) of the impeller assembly 12 to allow the impeller assembly 12 to rotate about the longitudinal axis L without contacting the flange 10 or the discharge side 30 of the nozzle 11. Additionally, the discharge side 30 of the nozzle 11 at least partially surrounds the front face 35. The relative proximity of the impeller assembly 12, particularly of the front face 35, and the discharge side 30 of the nozzle 11 further prevent or limit coolant from leaking back through the central opening 26 from the high-pressure cavity 18 to the low-pressure cavity 16. Bearings 36 (as best seen in FIG. 2) support the impeller assembly 12 for rotation about the longitudinal axis L and prevent the impeller assembly 12 from bending or deforming during operation.

As best seen in FIG. 2, the impeller assembly 12 includes an impeller shaft 38 with a square end 40. The impeller assembly 12 also has a relatively circular hub 42 (see FIG. 2). A central aperture 44 extends through the hub 42 so that the hub 42 can be coupled to the impeller shaft 38. A plurality of arcuately shaped blades 49 (see FIG. 1) are coupled to the front face 35 of the impeller assembly 12 and extend radially from the hub 42 curving toward the periphery of the front face 35. As shown in FIG. 2, the discharge side 30 of the nozzle 11 at least partially surrounds the arcuately shaped blades 49. The curvature of the arcuately shaped blades 49 facilitates the flow of coolant from the low-pressure cavity 16 into the high-pressure cavity 18 by creating an area of suction within the high-pressure cavity 18 which draws coolant from the low-pressure cavity 16 into the high-pressure cavity 18. Also, the curvature of the arcuately shaped blades 49 prevents or limits coolant from leaking past the impeller assembly 12 from the high-pressure cavity 18 to the low-pressure cavity 16.

Referring now to FIGS. 1 and 2, fastener openings 60 extend through the cover 8, the flange 10, the housing 6, and the crankcase 4. Fasteners 62 extend through the fastener openings 60, fastening the pump 2 to the crankcase 4. Also, the fasteners 62 hold the cover 8, the flange 10, the housing 6, and the crankcase 4 together, substantially sealing them together so that coolant cannot leak out of the pump 2.

The engine E includes a piston (not shown) that drives a crankshaft (not shown) housed within a crankcase wall 63. The crankshaft drives rotation of an intermediate shaft 64 about the longitudinal axis L (as show in FIG. 2). The intermediate shaft 64 has a recess 66 configured to mate with and to engage the square end 40 of the impeller shaft 38 in positive locking engagement. In this manner, the intermediate shaft 64 transfers rotational movement from the prime mover to the impeller assembly 12, and particularly the impeller shaft 38, thereby rotating the impeller assembly 12 about the longitudinal axis L.

The pump 2 is in fluid communication with the coolant loop (not shown) of the engine E so that the pump 2 can move coolant through the coolant loop to various elements within the engine E. Coolant used to cool the engine E enters the low-pressure cavity 16 of the pump 2 through a first inlet 68 (shown in FIGS. 1 and 2) or through a second inlet 70. The first inlet 68 extends through the cover 8 and is in fluid communication with the radiator (not shown) so that coolant entering the pump 2 through the first inlet 68 is relatively cool. As shown in FIG. 2, coolant enters the low-pressure cavity 16 through the first inlet 68 along a coolant flow path 72 (represented by an arrow).

The second inlet 70 (as best seen in FIG. 2) also opens into the low-pressure cavity 16. Coolant entering the pump 2 through the second inlet 70 bypasses the radiator, instead traveling through the cooling loop of the engine E and flowing along a coolant flow path 74 (represented by an arrow). During startup and relatively soon thereafter, the coolant is relatively cool and therefore does not need to travel through the radiator to be cooled. Therefore, at startup and relatively soon thereafter the coolant is cycled through the cooling loop, bypassing the radiator and returning to the low-pressure cavity 16 through the second inlet 70 along the coolant flow path 74. After the engine E begins to warm up, thereby warming the coolant, at least a portion of the coolant is cycled through the radiator and therefore enters the pump 2 through the first inlet 68 traveling along the coolant flow path 72.

As shown in FIG. 2, coolant from the cooling loop enters the pump 2 through a coolant duct 76 and an inlet channel 78. The coolant duct 76 extends through the crankcase wall 63 and opens into the inlet channel 78. The inlet channel 78 extends through a portion of the crankcase 4. From the inlet channel 78, coolant flows along a flow path 79 (represented by an arrow) through a housing opening 80 (see FIGS. 1 and 2), a flange opening 82 (see FIG. 1), the second inlet 70 and into the low-pressure cavity 16. The housing opening 80 is an aperture that extends through the housing 6. The flange opening 82 is a similar aperture that extends through the flange 10.

The impeller assembly 12, and particularly the arcuately shaped blades 49, draw coolant from the low-pressure cavity 16, through the central opening 26 and the nozzle 11 along a coolant flow path 84 (represented by an arrow), which is substantially coaxial with the longitudinal axis L. The fluid is drawn past the lip 34 and into the nozzle 11. The nozzle 11 is contoured to guide coolant through the central opening 26, minimizing turbulence and maintaining relatively laminar flow through the central opening 26. The arcuately shaped blades 49 then change the direction of the coolant flow path 84. As seen in FIG. 2, the arcuately shaped blades 49 direct coolant radially outwardly along the coolant flow path 86 (represented by an arrow), away from the longitudinal axis L, and into a discharge channel 88 (as best seen in FIG. 2) communicating with the coolant loop along a coolant flow path 90 (represented by an arrow). Coolant leaves the second cavity 18 through the discharge channel 88. From the discharge channel 88, the coolant is conveyed throughout the engine E to cool various elements within the engine E.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

What is claimed is:

1. A pump comprising:

a housing;

a cover sealingly coupled to the housing;

an impeller assembly located between the housing and the cover, the impeller assembly having at least one impeller blade and a shaft defining a longitudinal axis, the shaft being rotatable about the longitudinal axis; and a flange providing a seal between the housing and the cover, the flange positioned between the housing and the cover adjacent the impeller assembly such that the flange and the cover define a first cavity, the flange and the housing define a second cavity, and the flange includes an opening fluidly connecting the first and second cavities, the flange being contoured to at least partially surround the impeller assembly.

2. The pump of claim 1, wherein the flange includes a nozzle contoured to direct a coolant from the first cavity toward the second cavity and onto the impeller assembly, and wherein the nozzle has an intake side communicating with the first cavity and a discharge side communicating with the second cavity.

3. The pump of claim 2, wherein the flange is metallic, and wherein the nozzle is integral with the flange.

4. The pump of claim 2, wherein the nozzle is a converging-diverging nozzle.

5. The pump of claim 1, wherein the impeller assembly includes a front face having a plurality of blades.

6. The pump of claim 5, wherein the flange is contoured to at least partially surround the front face.

7. The pump of claim 5, wherein the blades are configured to direct a fluid axially from the first cavity along a path substantially parallel to the longitudinal axis, through the opening, and radially into the second cavity.

8. A motorcycle engine comprising:

a crankcase;

an intermediate shaft in the crankcase; and a pump driven by the intermediate shaft and including:

a housing;

a cover sealingly coupled to the housing;

an impeller assembly located between the housing and the cover, the impeller assembly having at least one impeller blade and a shaft defining a longitudinal axis, the shaft being rotatable about the longitudinal axis; and a flange positioned between the housing and the cover adjacent the impeller assembly such that the flange and the cover define a first cavity, the flange and the housing define a second cavity, and the flange includes an opening fluidly connecting the first and second cavities, the flange being contoured to at least partially surround the impeller assembly.

9. The motorcycle of claim 8, wherein the flange includes a nozzle contoured to direct a coolant from the first cavity toward the second cavity and onto the impeller assembly, and wherein the nozzle has an intake side communicating with the first cavity and a discharge side communicating with the second cavity.

10. The motorcycle of claim 9, wherein the flange is metallic, and wherein the nozzle is integral with the flange.

11. The motorcycle of claim 9, wherein the nozzle is a converging-diverging nozzle.

12. The motorcycle of claim 8, wherein the impeller assembly includes a front face having a plurality of blades.

13. The motorcycle of claim 12, wherein the flange is contoured to at least partially surround the front face.

14. The motorcycle of claim 12, wherein the blades are configured to direct a fluid axially from the first cavity along a path substantially parallel to the longitudinal axis, through the opening, and radially into the second cavity.

15. A pump for circulating a coolant through an internal-combustion engine, the pump comprising:

a housing;

a cover sealingly coupled to the housing;

an impeller assembly located between the housing and the cover, the impeller assembly having at least one impeller blade and a shaft defining a longitudinal axis, the shaft being rotatable about the longitudinal axis;

a flange positioned between the housing and the cover adjacent the impeller assembly such that the flange and the cover define a first cavity, the flange and the housing define a second cavity, and the flange includes an opening fluidly connecting the first and second cavities, the flange being contoured to at least partially surround the impeller assembly; and a nozzle coupled to the flange and contoured to direct a coolant from the first cavity to the second cavity and onto the impeller assembly, the nozzle having an intake side communicating with the first cavity and a discharge side communicating with the second cavity, wherein the nozzle is a converging-diverging nozzle.

16. The pump of claim 15, wherein the flange is metallic, and wherein the nozzle is integral with the flange.

17. The pump of claim 15, wherein the impeller assembly includes a front face having a plurality of blades.

18. The pump of claim 17, wherein the discharge side of the nozzle is contoured to at least partially surround the front face.

19. The pump of claim 17, wherein the blades are configured to direct a fluid axially from the first cavity along a path substantially parallel to the longitudinal axis, through the opening, and radially into the second cavity.

* * * * *